United States Patent [19]

Thorpe

[11] 3,968,332

[45] July 6, 1976

[54] TOY CARBON MICROPHONE

[75] Inventor: Dinsdale Thorpe, Bronx, N.Y.

[73] Assignee: Lawrence Peska Associates, Inc., New York, N.Y. ; a part interest

[22] Filed: June 5, 1975

[21] Appl. No.: 584,195

[52] U.S. Cl. ..... 179/141

[51] Int. Cl.[2] ..... H04R 21/02

[58] Field of Search..... 179/131, 136, 137, 138 R, 179/140, 141, 142, 143, 144, 145, 178, 181 R

[56] References Cited

UNITED STATES PATENTS

| | | | |
|---|---|---|---|
| 316,204 | 4/1885 | Waite et al. | 179/136 |
| 508,829 | 11/1893 | Noriega | 179/145 |
| 666,677 | 1/1901 | Holcombe | 179/137 |
| 3,909,558 | 9/1975 | O'Brien | 179/141 |

*Primary Examiner*—Kathleen H. Claffy
*Assistant Examiner*—George G. Stellar
*Attorney, Agent, or Firm*—Jack D. Slobod

[57] ABSTRACT

A resistance microphone for a toy telephone mouthpiece includes a pair of circularly bored cylindrical carbon cups secured to a plastic sheet diaphragm in opposed spaced apart relationship and a cylindrical carbon rod having two conical ends held loosely in the cups. Holes are provided in the diaphragm on opposite sides of the cups and wires are wrapped around the cups, in annular grooves in the cup peripheries, threaded through the openings and twisted onto themselves to both secure the cups to the diagram and to provide contact leads for the microphone.

2 Claims, 3 Drawing Figures

TOY CARBON MICROPHONE

FIELD OF THE INVENTION

The present invention relates generally to resistance microphones of a type utilizing carbon electrodes which are variably pressed into contact by the movement of a diaphragm. In its particular aspects the present invention relates to a microphone formed of a carbon rod, loosely suspended lengthwise between carbon cups which are secured to a plastic diaphragm by lead in wires for the cups.

BACKGROUND OF THE INVENTION

The usual resistance microphone in use today comprises a cell containing granulated carbon particles which are variably pressed together by acoustic forces. In producing inexpensive toy telephone systems it has been found that the aforementioned type of microphone represents an inordinate proportion of the cost of the system. Consequently, the need exists for a simple and inexpensive microphone for such systems. In the early prior art, carbon pencil type microphones were utilized in conjunction with a sounding board such as that demonstrated by Hughes in 1878 as illustrated at page 7 in the Bell Telephone System publication "The Carbon Microphone" by F. S. Goucher. That type of carbon microphone was abandoned primarily because of the need for a modern sounding board, in favor of the modern granulated carbon microphone. I have found that the pencil microphone has the capability to be produced more easily and less expensively than the granulated carbon microphone, and have undertaken to analyze how the pencil type microphone could be produced in a highly inexpensive form for use in a toy telephone.

OBJECTS OF THE INVENTION

It is an object of the present invention to provide a simple and inexpensive pencil type microphone.

It is a further object of the present invention to provide a microphone which is much less expensive to produce than a granular carbon microphone and which can be assembled without any special tooling.

SUMMARY OF THE INVENTION

Briefly, the aforementioned and other objects of the present invention are satisfied by providing a microphone in the form of a cylindrical carbon rod loosely suspended lengthwise between a pair of opposed circularly bored carbon cups which are secured to a plastic diaphragm in spaced apart relationship. By utilizing a diaphragm in the form of a die cuttable plastic sheet to replace the prior art sounding board, a simple and inexpensive microphone results which can be hand assembled from only four main parts, the diaphragm, the rod, and the two cups. To further simplify the construction and assembly of the microphone, according to the present invention, a pair of holes are provided in the diaphragm on opposite sides of each cup and a wire is passed through one hole, around the cup, through the other hole and then twisted onto itself to simultaneously provide both means for securing the cups to the diaphragm and electrical connections to the cups. There is further provided an annular groove around the periphery of each cup, into which the wrapped wire is channeled to facilitate holding the cups in place.

Other objects, features and advantages of the present invention will become apparent upon perusal of the following detailed description of the preferred embodiment thereof when taken in conjunction with the appended drawing wherein.

DETAILED DESCRIPTION

Figure 1:
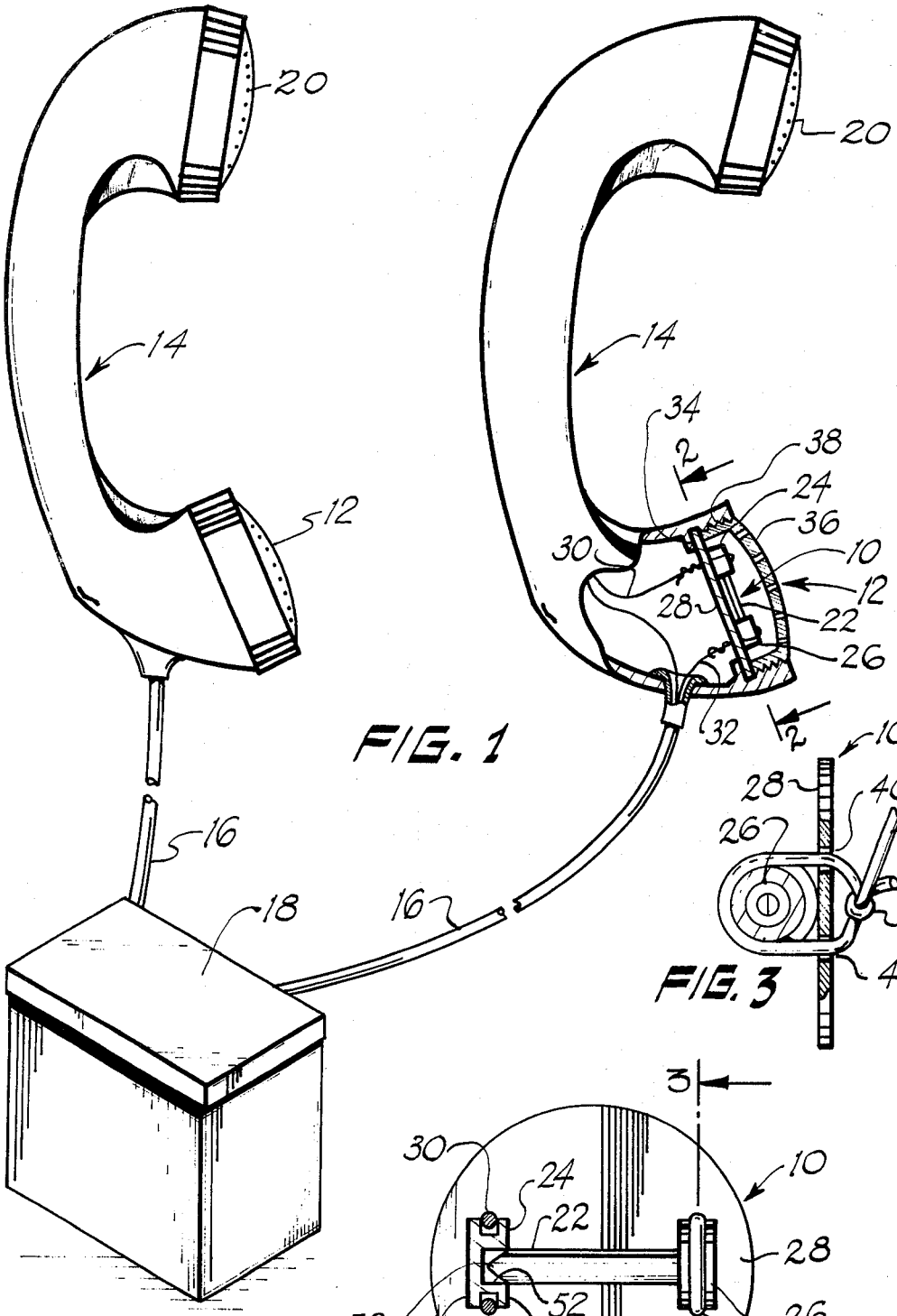
FIG. 1 is a pictorial presentation of a toy telephone system which is partially in section to illustrate the microphone of the present invention.

Referring to FIG. 1, resistance microphones 10 of the present invention are retained in the mouthpiece portions 12 of a pair of telephone type hand held receivers 14. Receivers 14 are each connected by a separate two wire cable 16 to a battery case 18. As is usual in toy telephone systems, the microphones 10, the speakers within the ear engaging portions 20 of the receivers 14, and the batteries in the battery case 18 are all connected in single series circuit. Thus, acoustic energy applied to either of the microphones 10 varies its resistance and thereby produces a sound modulated electric current which is transduced to sound in both ear engaging portions 20.

As distinguished from the usual granular carbon microphone, which has been found to be quite expensive for toy telephone systems, the microphone 10 of the present invention comprises a cylindrical carbon rod or pencil 22 which is lengthwise suspended loosely between a pair of carbon cups 24 and 26. The cups 24 and 26 are secured to a circular sheet 28 in spaced apart opposed relationship. Sheet 28 is formed of inexpensive die cuttable plastic, such as five mil thick polystyrene or polyethylene which is sufficiently flexible to serve as a diaphragm. As the diaphragm 28 flexes and oscillates in response to acoustic forces, cups 24 and 26 carried by the diaphragm assume variably canted angular orientations. As a result of the angulation of the cups 24 and 26 a variable sound modulated contact resistance is created between the cups and the ends of rod 22. This contact resistance is reflected between the microphone leads 30 and 32 which are respectively secured in electrical contact with the cups 24 and 26.

The microphone 10 is simply retained in mouthpiece 12 by the provision of a radially inwardly directed flange 34 on which rests an annular circumferential portion of the circular diaphragm 28. A perforated cover 36 is threaded into internal threads 38 in the generally cylindrical mouthpiece portion 12 and traps the diaphragm 28 against the flange 34.

Figure 3:
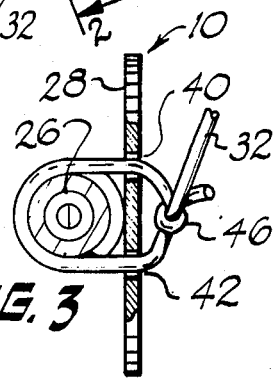
FIG. 3 is a cross-sectional side view taken along the lines 3—3 in FIG. 2.
Figure 2:
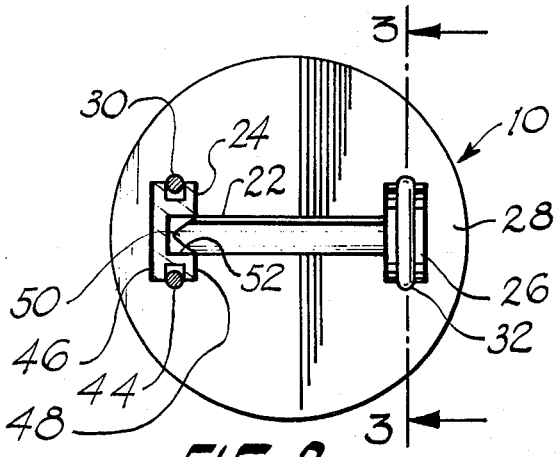
FIG. 2 is an enlarged top view partially in section of the microphone of the present invention as viewed generally from the arrows 2—2 in FIG. 1.

FIGS. 2 and 3 show enlargements of the microphone 10 in order to discern further detail. Therein, the carbon cups 24 and 26 are generally cylindrical in shape and have opposed circular bores. Further, for securing the cups 24 and 26 to diaphragm 28, there is a provided a separate pair of holes 40 and 42 in diaphragm 28 on opposite sides of each cup. The lead in wires 30 and 32, for the cups 24 and 26, are fed first through one hole, such as 42, then tightly around the outer circular periphery of the cups channelled within a circumferential groove 44 provided midway along the length of each cup and then through the opposite hole, such as 40. The free end of each wire is then twisted around itself several times as at 46. By this simple, yet ingenious technique the base lead in wires 30 and 32 simultaneously make electrical contact with the respective cups 24 and 26 and secure the cups to the diaphragm 28. As a result of cutting the grooves 44 in the cups a pair of radially outwardly directed flanges 46 and 48 are formed which serve to lock the cups 24 and 26 in place longitudinally about the lead in wires 30 and 32.

To provide a great deal of resistance variation in the microphone 10, in response to flexing of the diaphragm 28, the opposite ends of rod 22 are each provided with a generally conical point 50 which fits somewhat loosely in the cylindrical or circular central bores 52 of the cups 24 and 26. Thus the amount of contact area between the cylindrical wall of bore 52 and the conical sides of point 50 is varied in response to angulation of the cups, yielding a large variation in resistance.

Having described the preferred embodiment of my invention in detail, it should be apparent that numerous modifications, additions and omissions to the details thereof are possible within the spirit and scope of the invention. Hence, reference as to the scope of my invention should be made to the following claims.

What is claimed is:

1. A resistance microphone comprising a diaphragm formed of a plastic sheet, a pair of carbon cups having outer peripheries and circular bores, means for mounting said cups on said diaphragm in spaced apart opposed relationship, a carbon cylindrical rod having generally conical opposite ends, opposite ends of the rod being held loosely in opposite bores of the cups, and a pair of leads electrically connected respectively to said pair of cups and a pair of holes in said diaphragm on opposite sides of each cup, and wherein said mounting means comprises said leads respectively wrapped around the outer periphery of said cups and through said pairs of holes.

2. The microphone of claim 1 wherein said mounting means further comprises groove means around the outer periphery of said cups, said leads being wrapped in said groove means.

* * * * *